United States Patent [19]

Thill

[11] Patent Number: 4,837,864

[45] Date of Patent: Jun. 13, 1989

[54] ARTICLE OF CLOTHING WITH THREE DIMENSIONAL APPLIQUE

[75] Inventor: Gerald D. Thill, Eden Prairie, Minn.

[73] Assignee: Spearhead Industries, Inc., Eden Prairie, Minn.

[21] Appl. No.: 147,979

[22] Filed: Jan. 25, 1988

[51] Int. Cl.[4] ..... A41D 27/08; A41B 1/00

[52] U.S. Cl. ..... 2/244; 2/115

[58] Field of Search ..... 2/49 R, 75, 80, 244; 446/28

[56] References Cited

U.S. PATENT DOCUMENTS

| | | | |
|---|---|---|---|
| 2,582,699 | 1/1952 | Jelaso et al. | 446/28 |
| 3,308,479 | 3/1967 | Sesco, Jr. | 446/28 |
| 3,447,165 | 6/1969 | Brosk | 2/75 |
| 3,484,974 | 12/1969 | Culmone | 2/244 |
| 3,608,092 | 9/1971 | Taranto | 2/49 R |
| 4,365,353 | 12/1982 | Rayl | 446/28 |
| 4,591,521 | 5/1986 | Freno et al. | 2/80 |
| 4,627,110 | 12/1986 | Tengs | 2/244 |
| 4,710,979 | 12/1987 | Bull et al. | 2/49 R |

*Primary Examiner*—Werner H. Schroeder
*Assistant Examiner*—Jeanette E. Chapman

[57] ABSTRACT

An article of clothing to which a three dimensional applique is applied to provide a decorative effect. The applique is of a flexible non-cloth material such as vinyl, various plastics or rubber which is attached to the frontal panel of a T-shirt or sweater with the attachment accomplished either through sewing or other positive connectors. The three dimensional applique is formed through various molding processes and the shirt or sweater may be cut to receive the same.

6 Claims, 1 Drawing Sheet

ARTICLE OF CLOTHING WITH THREE DIMENSIONAL APPLIQUE

FIELD OF THE INVENTION

This invention relates generally to articles of clothing and more specifically to upper torso coverings to which a non-cloth applique of three dimensional configuration is positively attached.

SHORT SUMMARY OF THE INVENTION

A shirt such as a T-shirt, sweater or the like to which a three dimensional applique is secured for decorative and non-functional purposes. A pullover or T-shirt has a predetermined cut out area to which the three dimensional applique is secured at the edges of the cut out area. The three dimensional applique may take many forms such as a light switch, an animal's head, one half of a bottle or any other desired shape. The three dimensional unit is molded of a vinyl or other plastic or rubber material in a separate process and is attached to, preferrably the front pannel of a shirt as a decorative element.

Preferrably the front panel of the shirt is cut in accordance with the dimensions of the three dimensional unit that will be attached such that the cloth which would normally be in the cut out area will not shrink or distort the three dimensional element.

BACKGROUND AND OBJECTS OF THE INVENTION

The applicant has reviewed the presently available commercial art and has found no article of clothing having the same concept as disclosed herein.

The applicant has also considered the patented prior art and has found the following listed patents: DiMaria, U.S. Pat. No. D279,322; Bottom et al, U.S. Pat. No. 4,466,136; DeBose, U.S. Pat. No. 4,310,927; Langdon, U.S. Pat. No. 4,354,282; Rayl, U.S. Pat. No. 3,365,353; and Deutsch, U.S. Pat. No. 4,570,206.

None of these patents utilize the concept of providing a three dimensional decorative element to a panel of a T-shirt, sweater or the like.

The DiMaria Patent is a Design Patent directed to the application of an applique to a T-shirt with the concept of being able to stuff or fill the applique to achieve a three dimensional effect. In order to achieve the three dimensional effect of DiMaria it is necessary to sew the applique onto the T-shirt and thereafter stuff the, now two surfaced design, with additional material.

The Bottom et al Patent utilizes a concept of printing on a T-shirt with a three dimensional element being temporarily attachable to complete the design.

The DeBose Patent is directed to a shirt having inflatable portions to achieve a three dimensional effect.

The Langdon Patent is simply a shirt with means for attaching elements thereto through the use of velcro connectors.

The Rayl and Deutsch Patents do not appear to contribute anything to the prior art that should be considered relevant to the applicant's concept.

DESCRIPTION OF A PREFERRED FORM OF THE INVENTION

Figure 1:
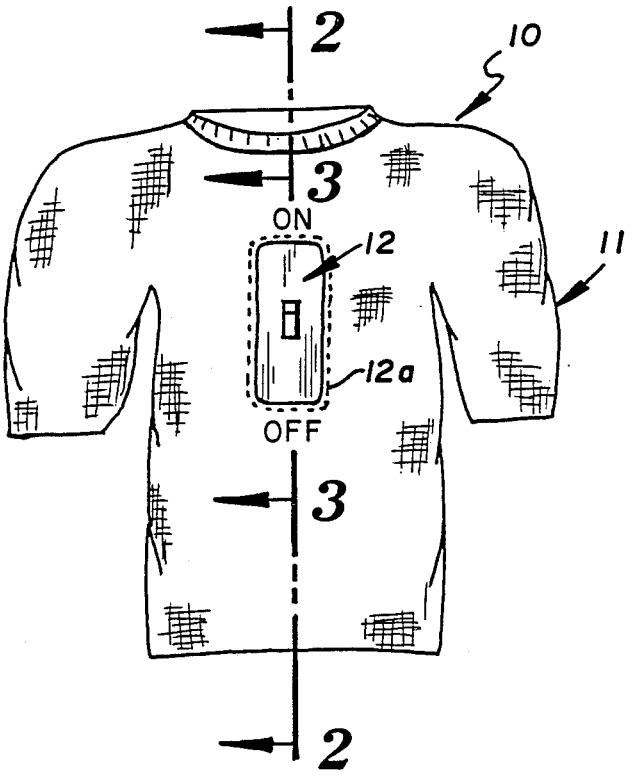
FIG. 1 illustrates a T-shirt to which an applique has been attached as an example of the applicant's invention.

In accordance with the accompanying drawings a complete article of clothing embodying the concepts of applicant's invention is illustrated in FIG. 1 and designated 10. The article of clothing selected to illustrate the applicant's invention is a T-shirt 11 to which a three dimensional applique 12 is applied.

As illustrated, the three dimensional applique in this instance is an on-off light switch and although shirt 11 illustrates the on-off designations as being printed onto the shirt 11 it should be obvious that these designations may be printed directly onto the three dimensional applique 12. This illustration does show that portions of the basic article of clothing 11 may be incorporated into the three dimensional applique 12 more thoroughly with imprinting thereon and thus illustrating that it is not necessary that the applique 12 be complete in and by itself.

Applicant has found that it is often beneficial to have the T-shirt 11 imprinted with various wordings such as advertisings and the like with the applique 12 providing a decorative or comic effect.

Figure 2:
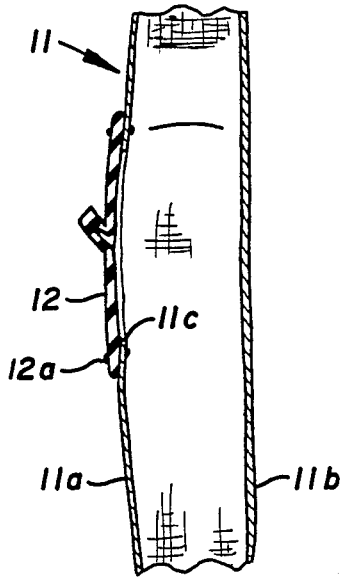
FIG. 2 is a vertical section taken substantially along line 2—2 of FIG. 1.

As illustrated in FIGS. 1 and 2, applicant has chosen that the applique 12 be applied to the front panel 11a of the T-shirt 11 although it should be obvious that this applique 12 could just as easily be placed on the back panel 11*b* of the T-shirt 11. It is also within the scope of the invention to provide the three dimensional applique to other articles of clothing.

As illustrated, the applicant has found that it is an advantage to cut an aperture such as at 11*c* to receive the applique 12 to bound the area of application of the applique. The removal of the material prevents distortion of the applique should the material of the article of clothing shrink. Very often T-shirts are made of cotton material and upon washing will shrink and this shrinkage would distort the three dimensional element applied thereto. If, however, the shirt were made of a non-shrinking material then it would not be necessary to remove the portion of material directly behind the applique.

Figure 3:
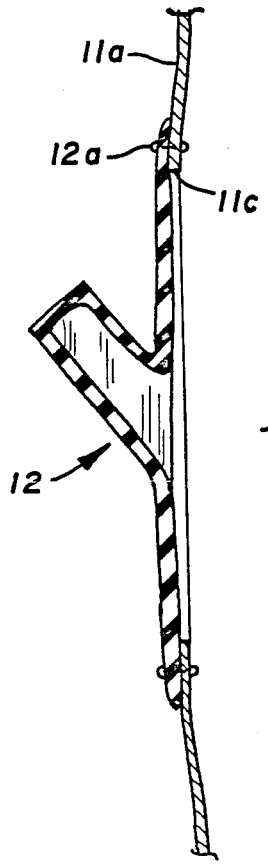
FIG. 3 is an additional vertical section taken along line 3—3 of FIG. 1 and being drawn to an enlarged scale.

As illustrated in FIG. 3 the applique is of a three dimensional configuration providing a formed skin as a hollow thin unit and may be equated to the facial portion of a mask. The processes for making such three dimensional units are well known in the art and such a three dimensional element may be provided with a particular peripheral flange such as 12*a* to provide an area of attachment to the material of the shirt.

As illustrated in FIG. 3 of the drawings the applique in this instance is stitched directly to the cloth material. Obviously the method utilized for attaching the applique to the cloth must be sufficiently positive to hold the same for not only where but also washing and cleaning processes. Sewing is an obvious method for such positive attachment.

Again, although stitching and sewing provides a positive means of attachment, it should be obvious that the applicant's concept encompasses removeability and replacement of the applique onto the shirt. This could be accomplished through buttons, snaps or other fastening devices which would permit the applique to be removed during cleaning processes and replaced upon completion of the process. Such application methods would, however, increase the cost of the entire unit.

The particular design of the applique incorporated is a matter of choice and purely illustrative and the applicant has many designs of a three dimensional nature to accommodate various situations. Three dimensional illustrations of various animals or persons could be utilized to identify sporting teams while products could be illustrated through a three dimensional illustration of a box or can in which the product is sold. Imprinting the applique then would be an obvious includion into the applicant's concept.

It should be obvious that the applicant has provided a new and unique ornamental article of clothing which includes a three dimensional applique attachable to at least a clear or what may be termed a flat panel of the article of clothing.

What is claimed is:

1. An article of clothing having a three dimensional applique, said article including:

a. a continuous front and rear panel and arms to provide a shirt;

b. an aperture formed in said front panel;

c. a formed, three dimensional article having a peripheral attachment flange;

d. said three dimensional article being received over said aperture; and, e. said peripheral flange of said three dimensional article being attached to the edges of said aperture, whereby said three dimensional article will extend forwardly through said front panel of the shirt.

2. The article of clothing as set forth in claim 1 and said three dimensional member providing a formed surface of selected characteristics.

3. The article of clothing as set forth in claim 1 and said formed member being formed of a plastic material.

4. The article of clothing as set forth in claim 1 and said formed member being formed of a rubber material.

5. The article of clothing as set forth in claim 1 and said three dimensional article providing a hollow interior portion.

6. The article of clothing as set forth in claim 1 and said three dimensional article being attached to said front panel through sewing thereof.

* * * * *